US010405632B2

(12) United States Patent
King

(10) Patent No.: US 10,405,632 B2
(45) Date of Patent: Sep. 10, 2019

(54) HAND REST

(71) Applicant: Poppy King Projects LLC, New York, NY (US)

(72) Inventor: Poppy King, New York, NY (US)

( * ) Notice: Subject to any disclaimer, the term of this patent is extended or adjusted under 35 U.S.C. 154(b) by 420 days.

(21) Appl. No.: 15/205,873

(22) Filed: Jul. 8, 2016

(65) Prior Publication Data

US 2017/0006994 A1 Jan. 12, 2017

Related U.S. Application Data

(60) Provisional application No. 62/191,022, filed on Jul. 10, 2015.

(51) Int. Cl.
*A45D 29/00* (2006.01)
*A45D 29/22* (2006.01)

(52) U.S. Cl.
CPC ..... *A45D 29/22* (2013.01); *A45D 29/00* (2013.01)

(58) Field of Classification Search
CPC ..... A45D 29/00; A45D 29/22; A47C 7/54; G09B 11/02; B43L 15/00
See application file for complete search history.

(56) References Cited

U.S. PATENT DOCUMENTS

D132,795 S * 6/1942 Sommers ..... 131/241
2,676,597 A * 4/1954 Colbert ..... A45D 29/22 132/73
4,332,263 A * 6/1982 Kitrell ..... A45D 29/22 132/73
4,441,487 A 4/1984 Daugherty et al.
4,524,789 A * 6/1985 Sazdanoff ..... A45D 29/22 132/73
5,152,486 A 10/1992 Kabanek et al.
5,184,795 A * 2/1993 Sexton ..... A45D 29/22 132/73
5,326,056 A 7/1994 Smith
5,762,302 A * 6/1998 Myers ..... A47B 21/0371 248/118.5
6,075,516 A 6/2000 Rice
D437,852 S 2/2001 Ledbetter et al.
D486,268 S 2/2004 Chien et al.
6,922,186 B2 7/2005 Whitcomb
D617,952 S 6/2010 Seychelle
D631,199 S 1/2011 Helm
(Continued)

OTHER PUBLICATIONS

International Search Report dated Sep. 23, 2016 from PCT/US16/41591.

*Primary Examiner* — Nicholas D Lucchesi
(74) *Attorney, Agent, or Firm* — Brad M. Behar & Associates, PLLC

(57) ABSTRACT

A hand rest device for use during the application of nail polish comprising a front, a back, a right side, a left side, a top surface, and a bottom surface, with said top surface configured in a generally convex shape having a rounded peak positioned near the back half of the top surface longitudinally and about the middle of the top surface laterally. The top surface of the device curves down from said peak to an outer edge of the hand rest device. The bottom surface is configured with a curved portion from the outer edge of the hand rest device (around the perimeter) down to a generally flat portion, the generally flat portion further comprising a plurality of rubber pads. The device could include a weight inside.

19 Claims, 11 Drawing Sheets

(56) References Cited

U.S. PATENT DOCUMENTS

| | | | | |
|---|---|---|---|---|
| D676,605 | S | 2/2013 | Marden | |
| D688,243 | S | 8/2013 | Widiaman et al. | |
| D688,244 | S | 8/2013 | Widiaman | |
| D689,494 | S | 9/2013 | Widiaman et al. | |
| D734,545 | S | 7/2015 | Cantu et al. | |
| D734,546 | S | 7/2015 | Baker et al. | |
| 9,192,219 | B2 * | 11/2015 | Le | A45D 29/22 |
| 2004/0045568 | A1 | 3/2004 | Abbott | |
| 2005/0104487 | A1 | 5/2005 | Mangano | |
| 2006/0118679 | A1 * | 6/2006 | Delgado | A61F 5/0118 248/118 |
| 2007/0291003 | A1 | 12/2007 | Fanelli et al. | |
| 2009/0260647 | A1 | 10/2009 | Ionis et al. | |
| 2015/0107615 | A1 | 4/2015 | Houlder | |

* cited by examiner

HAND REST

CROSS-REFERENCE TO RELATED APPLICATION

This application claims the benefit of U.S. Application Ser. No. 62/191,022 filed on Jul. 10, 2016 which is expressly incorporated herein in its entirety by reference thereto.

FIELD OF THE INVENTION

The invention relates generally to hand rests for use in connection with the application of nail polish to finger nails. More specifically, the invention relates to hand rest devices that create comfort for an individual having his/her nails manicured and/or polished. The invention is also a hand rest device that, when used, improves the appearance of self-applied nail polish.

BACKGROUND OF THE INVENTION

Manicures are a popular way of caring for the nails and hands and ensuring they look clean and professional. A manicure typically consists of trimming, filing, and shaping the free edge of the nail, pushing back the cuticles, and clipping any cuticles or hangnails from the nail plate. Next, the nail technician may massage the hands and then apply nail treatment to the nails or a clear base polish. For many people, especially women, a manicure also involves painting the nails with a colored polish or lacquer. This process may also be performed on toe nails, a pedicure.

Nail salons are ubiquitous and the cost of a basic manicure is fairly inexpensive. However, many people still choose to do their own nails, typically at home, as a matter of convenience, preference, cleanliness, or for time saving purposes. Unfortunately, it is difficult to obtain the appearance of a professional manicure when doing one's own nails. First, most nail salons use professional grade products or tools, e.g., cuticle oil or remover, electric nail files, and UV or LED drying lamps, that are not accessible to non-professionals or those outside the industry. Those professional grade products or tools are specifically designed to help the nail technician create a clean and professional looking finished manicure. For polishing the nails, those professional grade products help create a neat, even, shiny look without any stray polish on or around the cuticle. Second, it is more difficult for an individual to obtain the desired brush angle and stroke (e.g., between approximately 70 to 90 degrees with respect to the nail and in line with the length of the finger) when polishing his/her own nails than when one's nails are being painted by someone else. It is easier for a second individual facing the person whose nails are being polished to position his/her hand holding the nail polish brush in line with the finger on the nail to be painted and on a flat surface to steady the painting hand while the brush is contacted near the cuticle at an angle and pulled down the nail, preferably straight down and off of the front of the nail. Third, the precision required to create a neat, clean, even polish on all of one's nails, on both hands, is complicated by unsteady hands, and awkward angles/decreased nail visibility without moving the hands, etc. Most people, due to handedness, are more capable painting the nails on the non-dominant hand than the dominant hand. When an individual needs to use the non-dominant hand to paint the nails on the dominant hand, most people notice a decrease in the quality of the resulting manicure, e.g. stray polish on the cuticle surrounding the nail or a messy or streaky or uneven polish.

Nail art has also become increasingly popular. Nail art may include designs or characters that are painted directly onto the nail using a small brush, techniques of coloring the nail using sponge applications or various brush strokes, or the placement of decals, rhinestones, or the like onto the nail using adhesives. Another technique used for achieving a design on the nails is to apply tape in a pattern on top of the nail, such as small stripes or a chevron design, and then apply polish over the tape. Once the tape is removed, a design is left on the nail. For nail art applications, as with polish application, proper angling and a steady hand are important for creating a clean look.

Some nail technicians may place a wrist rest, such as a foam block, under the patron's wrist, allowing the hands to drape down facing the nail technician. While these devices may increase comfort for the individual having his/her nails painted and while the wrist rest devices may be somewhat helpful to the nail technician, they fail to stabilize the hand and the finger in a fixed position (the palm and fingers are unsupported between the finger tips and the wrist rest allowing the palm and fingers to move up and down) and they are not practical for use when doing one's own nails.

There is a need for a device that can be used when doing one's own nails, but also when having one's nails done by others including in-salon treatments, that supports the hand and fingers so that they do not move, a device that also angles the fingers at approximately 45 degrees with the supporting surface so that the hand holding the brush, when on the support surface (e.g., the table), can angle the brush between about 70 to 90 degrees with respect to the nail, and so that the hand can slide on the table. There is a need for a device that can be used when doing one's own nails that helps position the arm and wrist on the hand to be painted comfortably on the supporting surface and also creates the desired painting angles between the brush and the nail. There is need for a device that creates a more even application of nail polish when painting one's own nails, a device that helps reduce "pooling" of nail polish near the cuticle. There is a need for a device that can comfortably fit under the hand of the user to create the desired nail angle with the supporting surface, a device that has a generally convex upper surface and a generally flat lower surface. There is a need for such a device that is of at least two piece construction having a top component and a bottom component. Such device could also, but need not, include a weight inside for stability and to reduce the slidability of the device on the supporting surface.

SUMMARY OF THE INVENTION

Applicant has invented a new hand rest device that overcomes these and other shortcomings. While the invention will be described in connection with certain embodiments, it will be understood that the invention is not limited to those embodiments. To the contrary, the invention includes all alternatives, modifications and equivalents as may be included within the spirit and scope of the present invention.

Applicant has invented a device to improve the nail polish application process as well as the quality and appearance of a manicure and nail polish application, while also allowing a user to comfortably apply polish to his or her own nails.

The device according to the invention supports the palm and fingers of the user's hand stabilizing the hand with the user's finger tips off of the device so that they can rest on the supporting surface. The device angles the nails on the user's hand at between about 30 to 50 degrees, preferably about 45 degrees, with respect to the supporting surface (preferably a horizontal surface such as a table) so that gravitational forces pull liquid paint down away from the cuticle instead of "pooling" and drying near the cuticle creating an uneven finish which occurs when the finger and nail are about flat on a table. The device according to the invention allows for an angle of between about 70 and 90 degrees, preferably less than about 90 degrees, between the paint brush bristles and the nail (with the hand holding the brush on the supporting surface) which allows for the application of polish to the nail next to and against the cuticle without having the bristles overlap the cuticle which would undesirably apply polish onto the cuticle.

The invention, when viewed from above (the top) is an about oval shaped hand rest for use when manicuring and/or polishing finger nails. A portion of a user's palm and fingers are placed onto the device with the finger tips overhanging the edge of the device. The device has a generally convex upper surface with a rounded peak located near the back end of the device that fits comfortably under a user's palm allowing the palm to bend around and onto the convex top surface of the device.

The device comprises a front, a back, a right side, a left side, a top surface, and a bottom surface; said top configured in a generally convex shape having a rounded peak located near the back end of the top surface and also near the middle of the device between the left side and the right side, said top surface curving down from said peak towards the front, back and sides of said device; said bottom surface configured generally flat for resting on a flat supporting surface; with a curved edge around a perimeter of the device when the top surface meets the bottom surface around the front, back, left side, and right side of the device.

Preferably, the peak is located near the back end of the device at a location about ⅓ of the total length of the device (from back to front) forward from the back end. Preferably, the peak is also located at about the middle of the device between the left side and the right side.

The approximate slope of the curvature of the top surface of the device, from the front to the peak is approximately 20 degrees, it being understood that the surface is curved and that the 20 degree figure is an approximation for the position of the peak and the curvature of the surface. The peak could be positioned more toward the front or the back which will change that angle and thus other angles, such as anywhere between 10 to 30 degrees are included in the scope of the invention. As the peak is located closer to the back end of the device, the curvature on the back side of the top surface is steeper/greater than the curvature of the top surface between the peak and the front end. The angle of a straight line between the back and the peak is approximately 35 degrees. The peak could be positioned more toward the front or the back which will change that angle and thus other angles on the back side, such as anywhere between 25 to 45 degrees are included in the scope of the invention.

The device according to the present invention fits comfortably under a user's palm allowing the palm and fingers to bend around the convex shaped top surface of the device.

The hand rest according to the invention is intended to be smaller than the palm of the user's hand. The size of the device and the slopes/curvature of the top surface allows the fingers to splay and to rest on a table or surface with the finger nails angled downward.

The device according to the invention could be a solid single piece construction, a hollow interior single piece construction, or it can be two piece construction with or without a hollow interior. In one embodiment, the device is of two piece construction with a weight inside although embodiments without the weight are also included within the scope of the invention. Preferably, when a weight is included, a weight (or weights) in the range of 50 to 100 grams is included in the device to reduce the tendency for the hand rest to unintentionally slide on the supporting surface while the hand is on it. Although, preferably, the device according to the invention can slide readily on the supporting surface when the finger tips are lifted to allow the user to maneuver the hand and nails during the manicure process.

BRIEF DESCRIPTION OF THE DRAWINGS

The accompanying drawings, which are incorporated in and constitute a part of this specification, illustrate embodiments of the invention and, together with the general description of the invention given above and the detailed description of an embodiment given below, serve to explain the principles of the present invention. Similar components of the devices are similarly numbered for simplicity.

FIG. 1 is a front perspective view of the device.

FIG. 2 is a rear perspective view of the device.

FIG. 3 is a front view of the device.

FIG. 4 is a right side view of the device showing a X-axis and straight lines between, on the one hand the peak, and on the other hand, the front or the back of the device. These angles created by these lines create angles (a and b) that are used to define the location of the peak relative to the front and back of the device.

FIG. 5 is a left side view of the device.

FIG. 6 is a back side view of the device.

FIG. 7 is a bottom view of the device.

FIG. 8 is a bottom rear perspective view of the device.

FIG. 9 is a top view of the device.

FIG. 10 is a sectional view of the device taken at line 10 in FIG. 9.

DETAILED DESCRIPTION OF THE INVENTION

Figure 1:
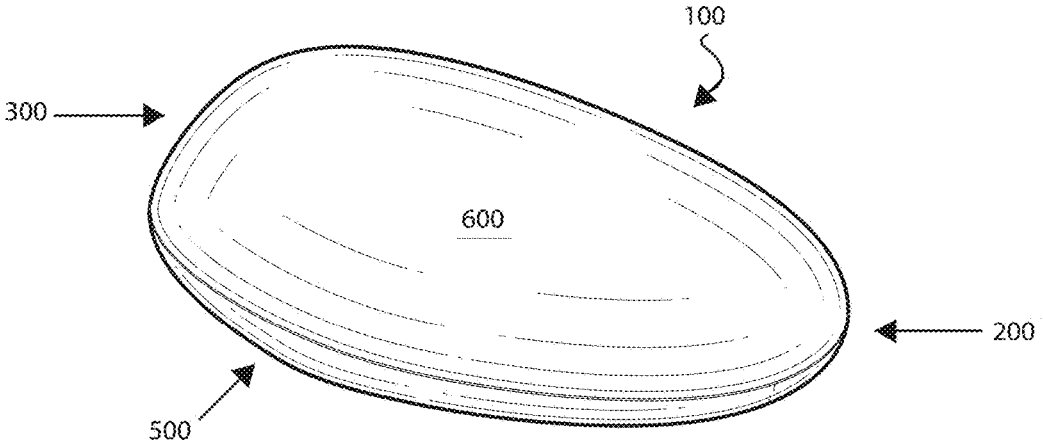
FIGS. 1-10 show one example embodiment of the hand rest according to the invention.
Figure 2:
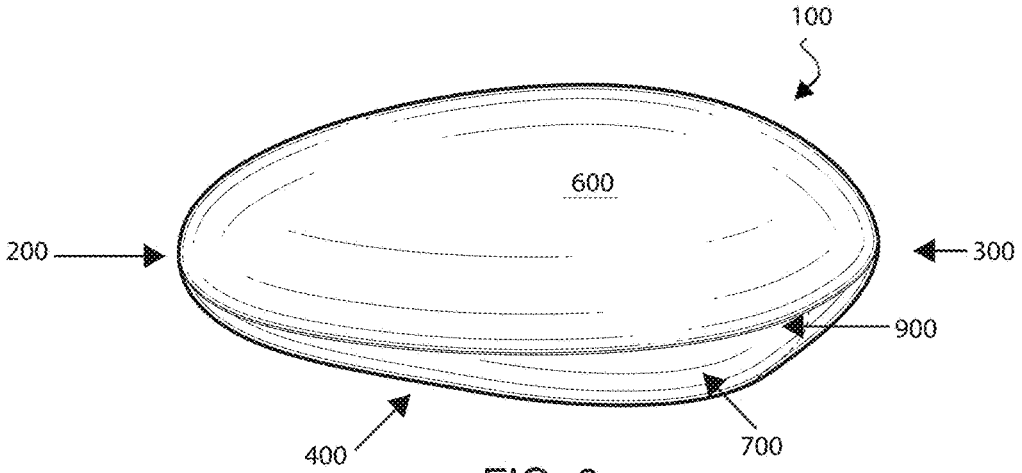
Figure 3:
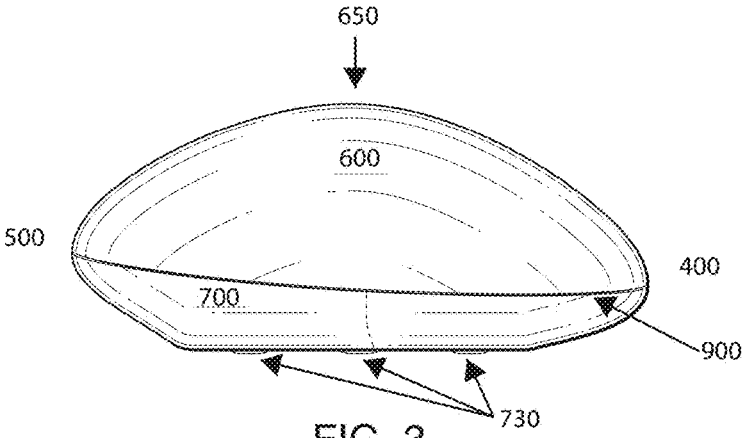

The accompanying drawings, which are incorporated in and constitute a part of this specification, illustrate embodiments of the invention and, together with the general description of the invention given above and the detailed description of an embodiment given below, serve to explain the principles of the present invention. Similar components of the devices are similarly numbered for simplicity.

FIGS. 1-10 show one example embodiment of the hand rest 100 according to the invention. The device has a generally convex upper surface with a rounded peak located near the back end of the device that fits comfortably under a user's palm allowing the palm to bend around and onto the convex top surface of the device.

The device 100 comprises a front 200, a back 300, a right side 400, a left side 500, a top surface 600, and a bottom surface 700. The top surface 600 is configured in a generally convex rounded/curved shape having a rounded peak 650 located near the back of the top surface and also near the middle of the device between the left side 500 and the right side 400. The top surface 600 curves down from said peak 650 all around the peak towards the edge of the device including the front 200, back 300, right side 400, and left side 500. The bottom surface 700 of the device includes a curved portion from the curved edge 900 of the device around the entire perimeter of the device down to a generally flat portion 750. The generally flat portion 750 of the bottom surface 700 of the device provides stability for the device when placed on a flat surface (e.g., a table). The curved edge 900 is around the perimeter of the device where the top surface 600 meets curved portion of the bottom surface 700.

Figure 4:
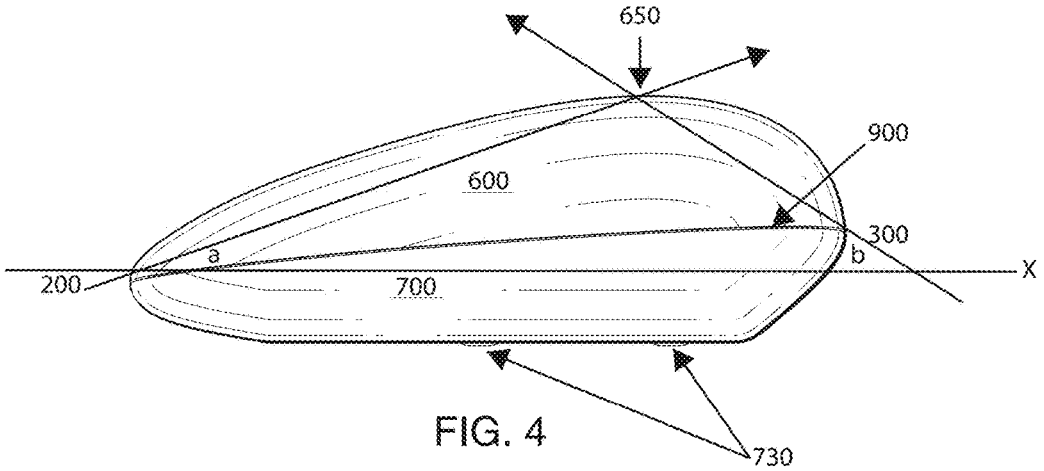
Figure 5:
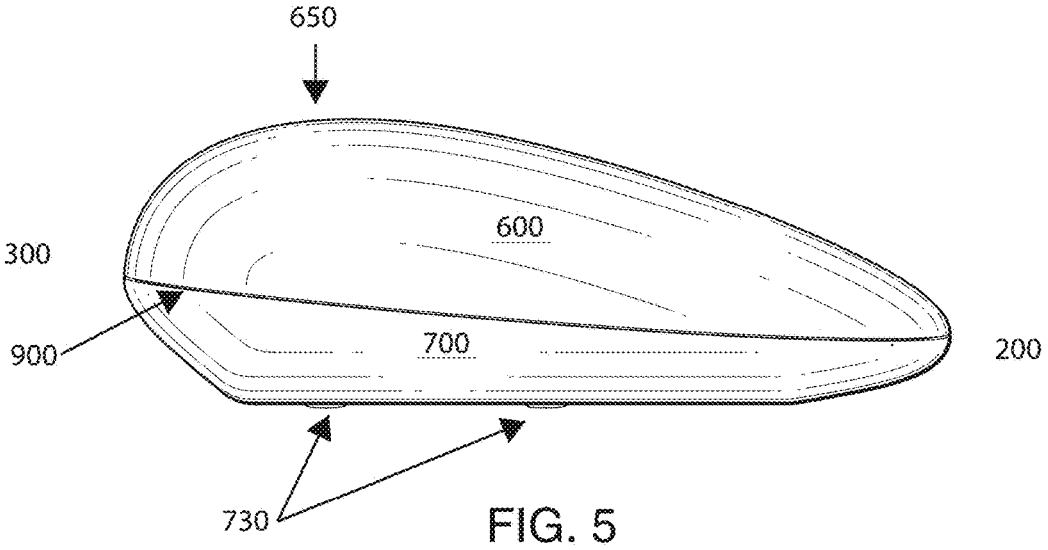
Figure 6:
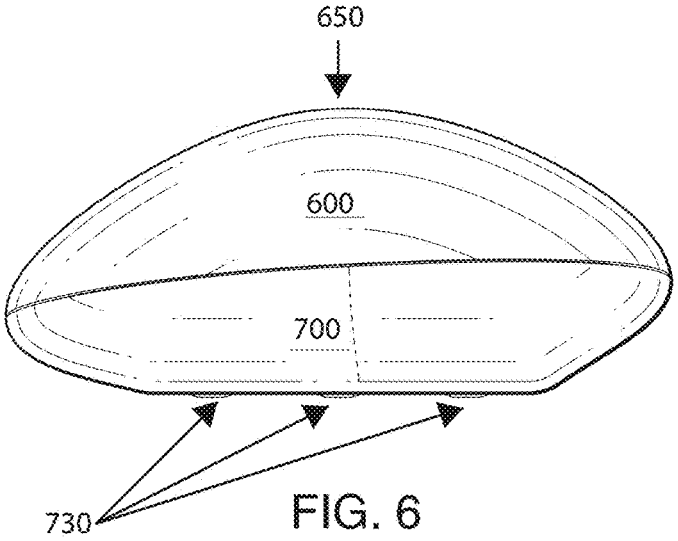
Figure 9:
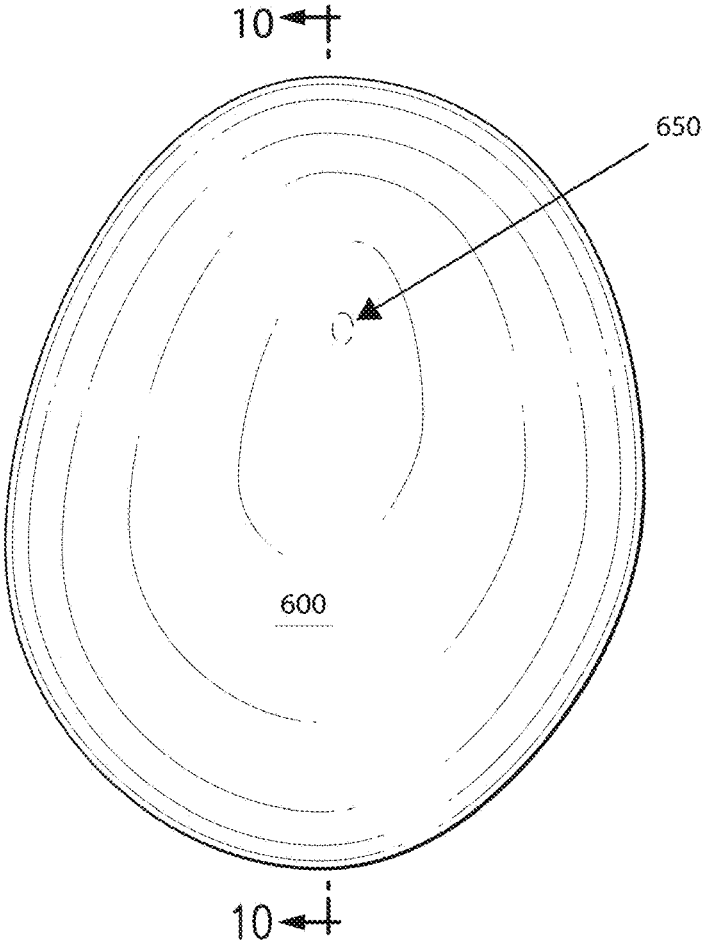
Figure 11:
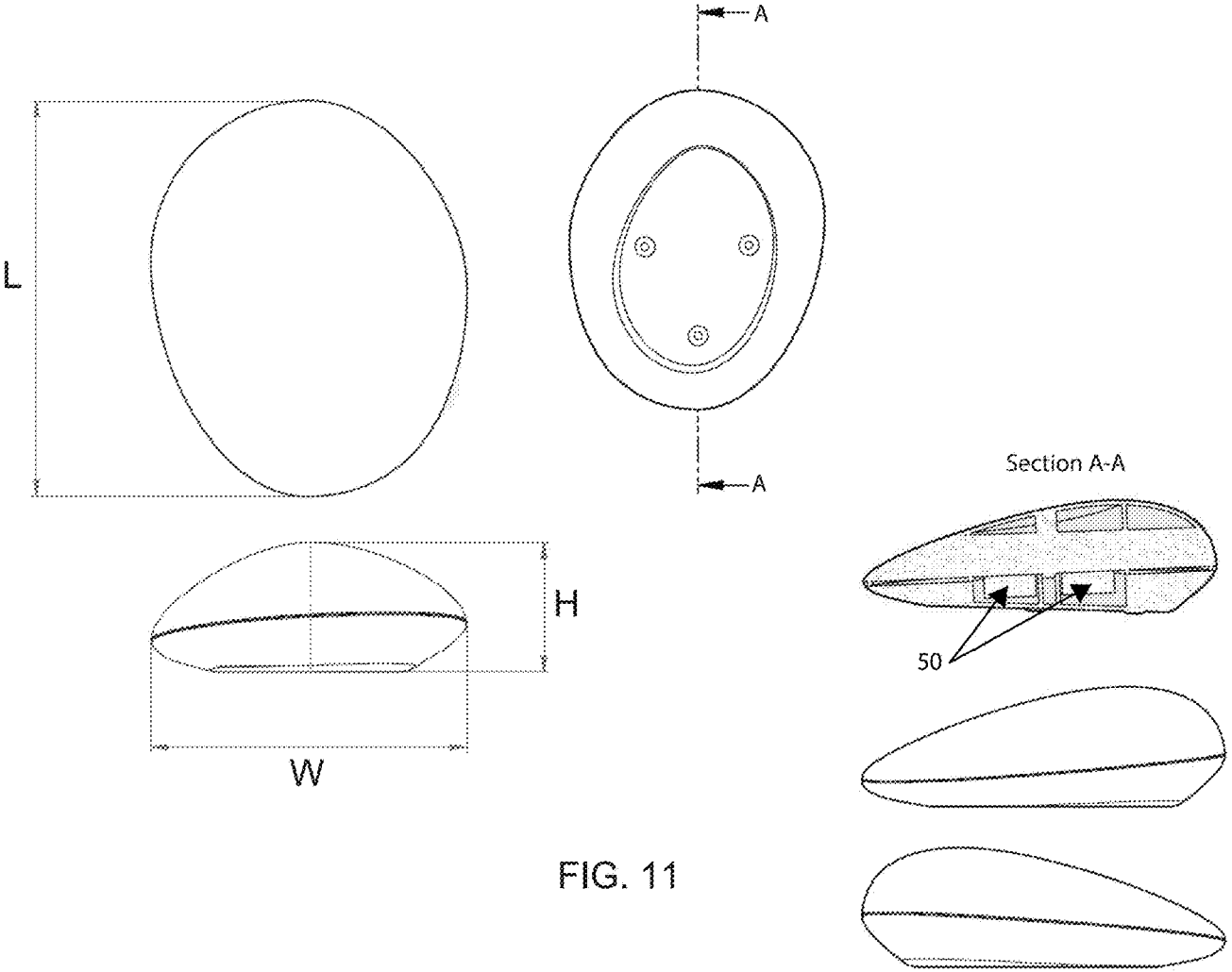
FIG. 11 shows multiple views of another embodiment of the device according to the present invention, including a top view, a bottom view, a front view, a left side view and a right side view, and a side sectional view of the device taken along its longitudinal length from the front to the back of the device.

Peak 650 is most preferably not located in the center of the top surface, although such a position for the peak 650 is included in the scope of the invention. Rather, peak 650 is preferably located closer to the back 300 of the device as shown in FIGS. 4 and 9. For example, peak 650 is longitudinally positioned about ⅓ of the total length L of the device (from back to front as seen in FIG. 11) forward from the back 300 and laterally positioned (from left to right as seen in FIG. 11) at about the middle of the device between the right side 400 and left side 500. It is understood that other peak positions are possible and included within the scope of the invention.

The top surface 600 is curved convexly from the edge 900 to the peak 650. Using an imaginary straight line between the front 200 to the peak 650, as shown in FIG. 4, the angle a for the device is preferably approximately 20 degrees, it being understood that the top surface 600 is curved and that the 20 degree figure is an approximation for the location of the peak with the curved surface raised above the imaginary straight line. When peak 650 is located closer to the back 300 (back of the middle of the device longitudinally along length L) of the device as shown in FIGS. 1-10, the angle b between an imaginary straight line from the back 300 to the peak 650 and the X-axis is approximately 35 degrees, steeper/greater than the angle a from the front 200 to the peak 650.

Preferably, but not necessarily, the height (H) of the device 100 is less than about one half of the maximum width (W) of the device 100 and the height (H) is about one third of the length (L) of the device 100. Example dimensions for the device are 27 mm in height, 66 mm in width and 82 mm in length it being understood that the device can be made in alternate sizes in the same proportions and in other proportions to fit hands of different sizes.

Figure 7:
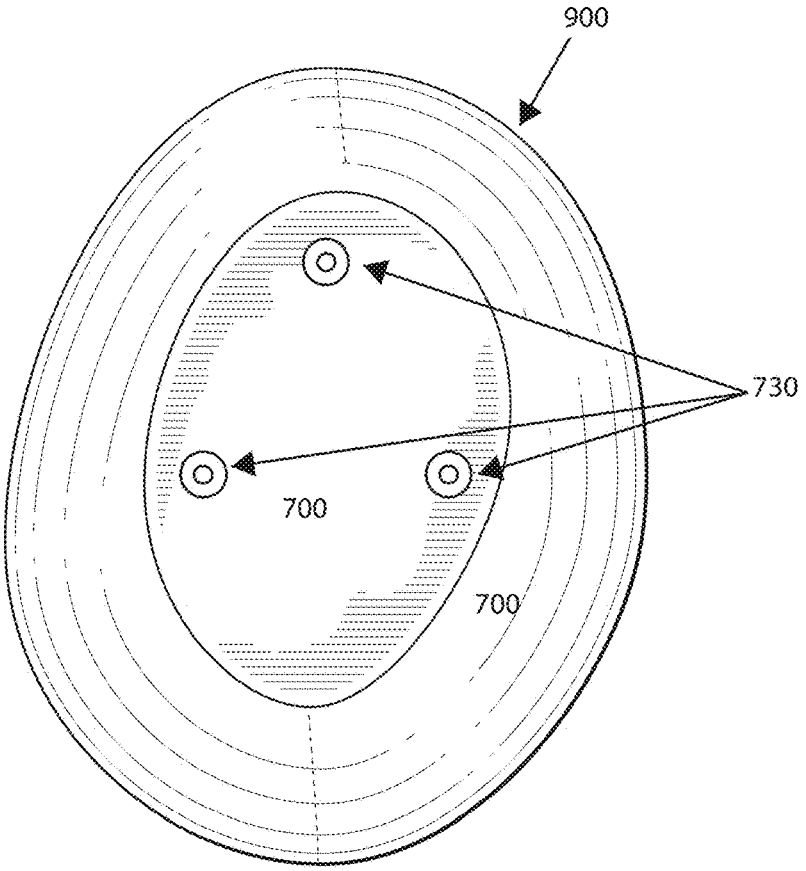
Figure 8:
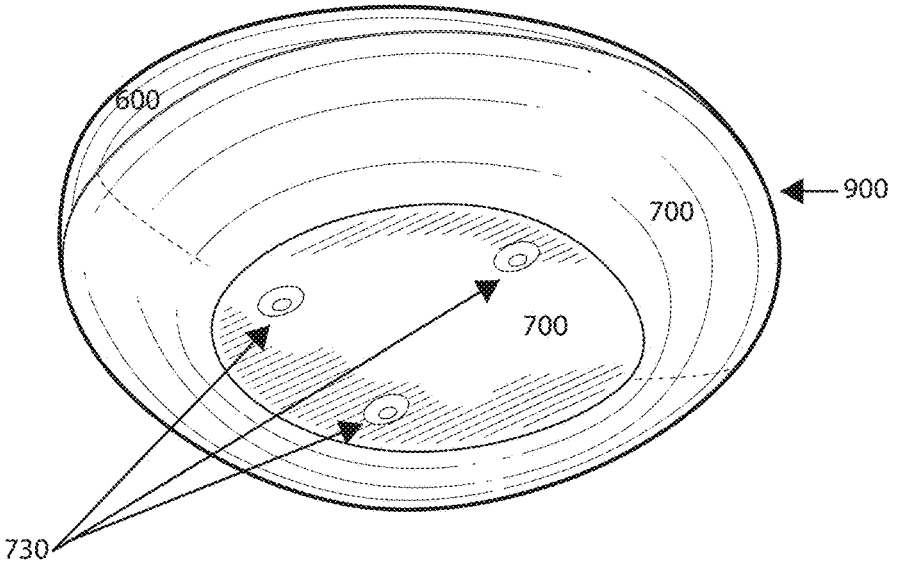

As shown in the Figures, including FIGS. 7 and 8, the generally flat portion of the bottom surface 700 of the device includes feet or grips, e.g., rubber pads, to prevent the hand rest device 100 from sliding on the supporting surface when in use.

Figure 10:
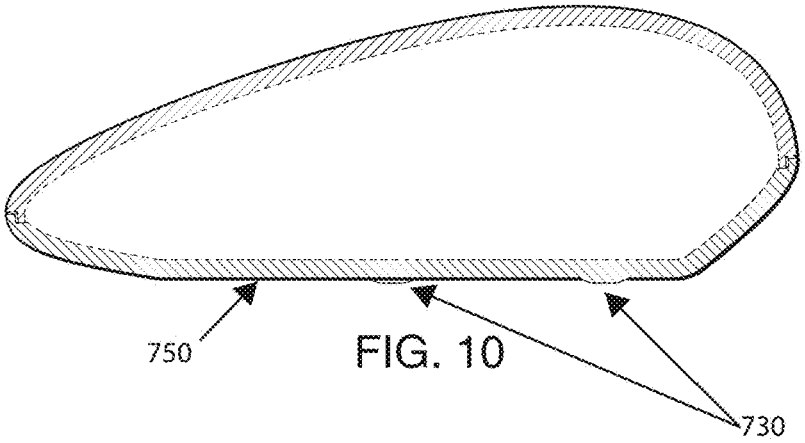

The hand rest device 100 according to the invention could be a solid single piece construction, a hollow interior single piece construction (as shown in FIGS. 9 and 10), or it can be two piece construction with or without a hollow interior.

Figure 12:
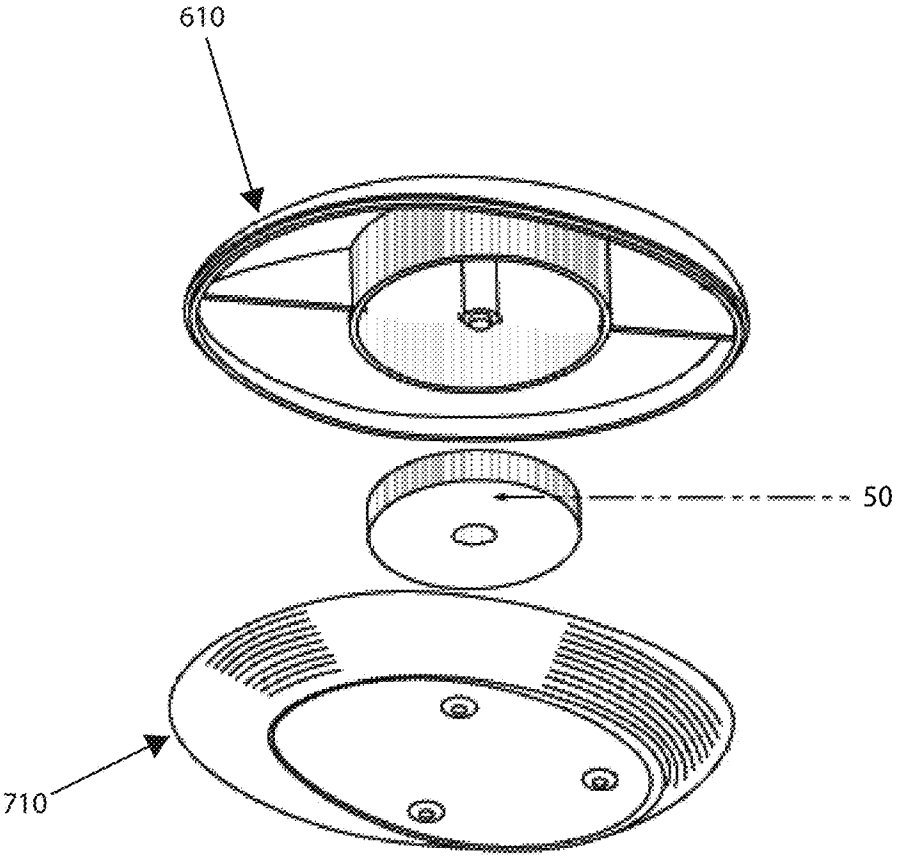
FIG. 12 is an exploded view of a hand rest device according to the present invention as shown in FIG. 11. The device shown in FIG. 12 is a two-piece construction device comprising a top cover and a bottom cover that detachably connect to each other along the edges of the covers which form the edge of the device. The device according to FIG. 12 also includes a weight positioned inside the device when the two covers are connected together as seen in FIG. 11.
Figure 13:
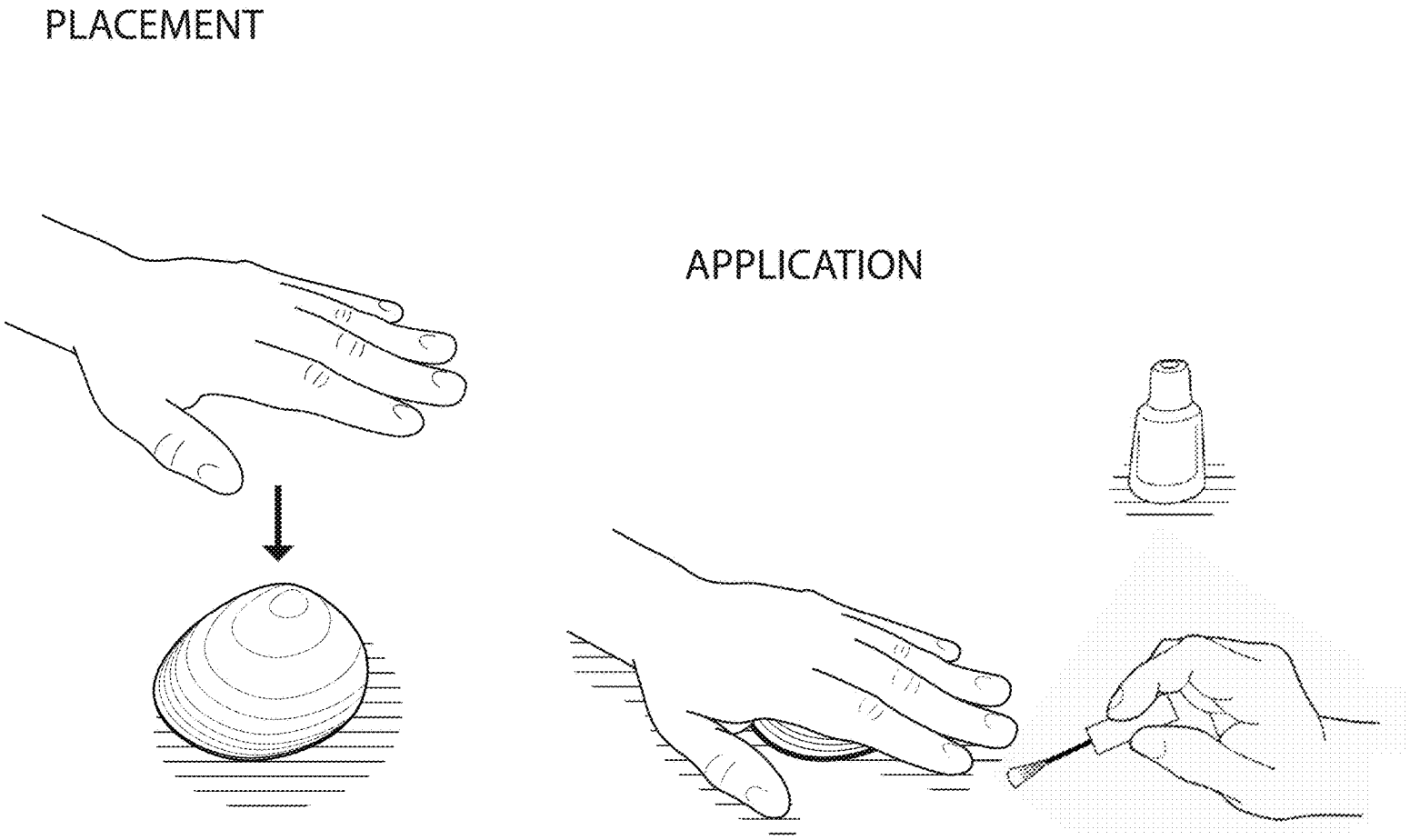
FIG. 13 shows how the hand rest device according to the invention is used to help apply nail polish. The hand rest device is positioned on a flat surface. The hand is placed onto the device with the center of the palm positioned at or in close proximity to the peak on the top surface of the device. The fingers are placed down onto the top surface with the finger tips overhanging the edge of the device resting on the table. The nail polish is then applied with the other hand or by another person as shown in FIG. 13.

When the device is of two piece construction with a weight inside as shown in FIGS. 11 and 12, a weight (or weights) somewhere in the range of 50 to 100 grams is included in the device to reduce the tendency for the hand rest to unintentionally slide on the supporting surface while the hand is on it. Although, preferably, the device according to the invention can slide readily on the supporting surface when the finger tips are lifted to allow the user to maneuver the hand and nails during the manicure process.

The two-piece construction device shown in FIG. 12 comprises a top cover 610 and a bottom cover 710 that detachably connect to each other along the edge 900 of the device. The top cover 610 and the bottom cover 710 can connect in a variety of ways known in the art including use of screws and threaded apertures, snap connections fittings, tabs and grooves, glue, heat sealed fittings, and the like. The embodiment shown in FIGS. 11 and 12 include weight 50 inside the device 100 between the top cover 610 and the bottom cover 710. The inside of the top cover 610 and/or the bottom cover 710 can be configured (e.g., molded) to receive and hold the weight 50 in place when the two covers are put together. Weight 50 preferably weighs about 3 ounces, more preferably about 1 ounce, it being understood that other quantities between 0.5 ounces and 5 ounces are possible and included within the scope of the invention.

Figure 16:
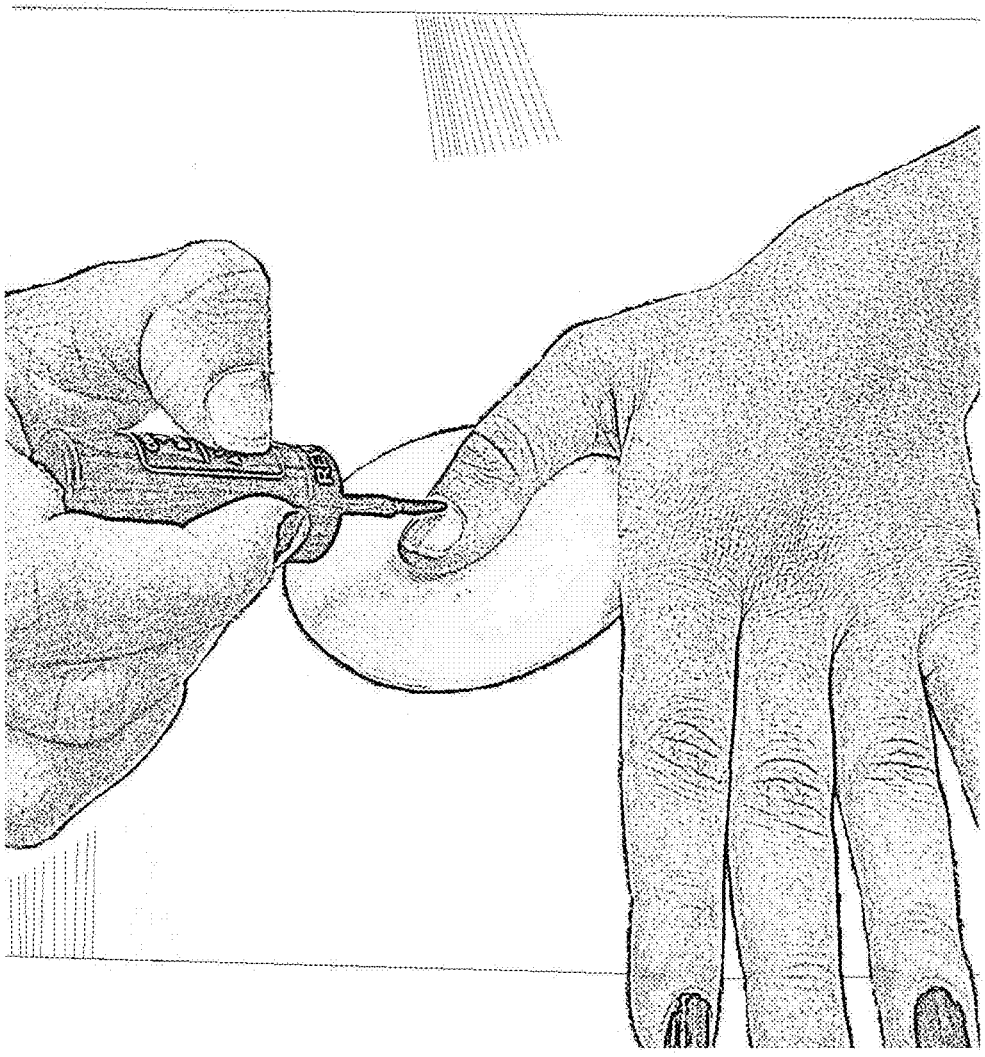
FIG. 16 shows how the device according to the invention is used to polish the thumb nail. The hand is repositioned on the device with the thumb metacarpal places near the peak on the top surface of the device. The entire thumb rests on the top surface of the device with the other finger tips resting on the table.

As shown in FIG. 16, the position of the hand on the device is altered when polishing the thumb nail. For the thumb, the hand is repositioned on the device with the thumb metacarpal placed near the peak on the top surface of the device. The entire thumb rests on the top surface of the device with the other finger tips resting on the table. The positioning of the thumb on the top surface is made easier with a contoured indentation (e.g., a thumb imprint) on the top surface of the device configured to receive the thumb. The thumb can then be placed into the contoured indentation when polishing the thumb nail. The contoured indentation helps position the thumb nail in an angled position. Although not shown in the Figure, such an indentation for the thumb would be located along the longitudinal direction of the device between the peak and the front (under the thumb shown in FIG. 16).

Yet another embodiment of the invention includes an opening/aperture and/or compartment within the bottom, a side, or the top of the device for storage of manicure tools or polish, such as, for example, a bottle of nail polish, nail file, and/or nail clipper. The device could include a slidable or removable portion of the top surface for access to a storage compartment inside the device and/or the bottom surface of the device may be removable for access to a storage compartment.

The device according to the invention can be made out of a variety of materials, including plastic, and the top surface may made of chrome or coated with chrome, for appearance and functionality. The coating helps to keep the top surface smooth and comfortable for the hand to easily rest on. The surfaces may also include a coating that is resistant to nail polish or nail polish remover and can easily be wiped down after each use to prevent build up of stray polish on the device. A metal finish resistant to acetone on the top surface is also within the scope of the invention.

Figure 14:
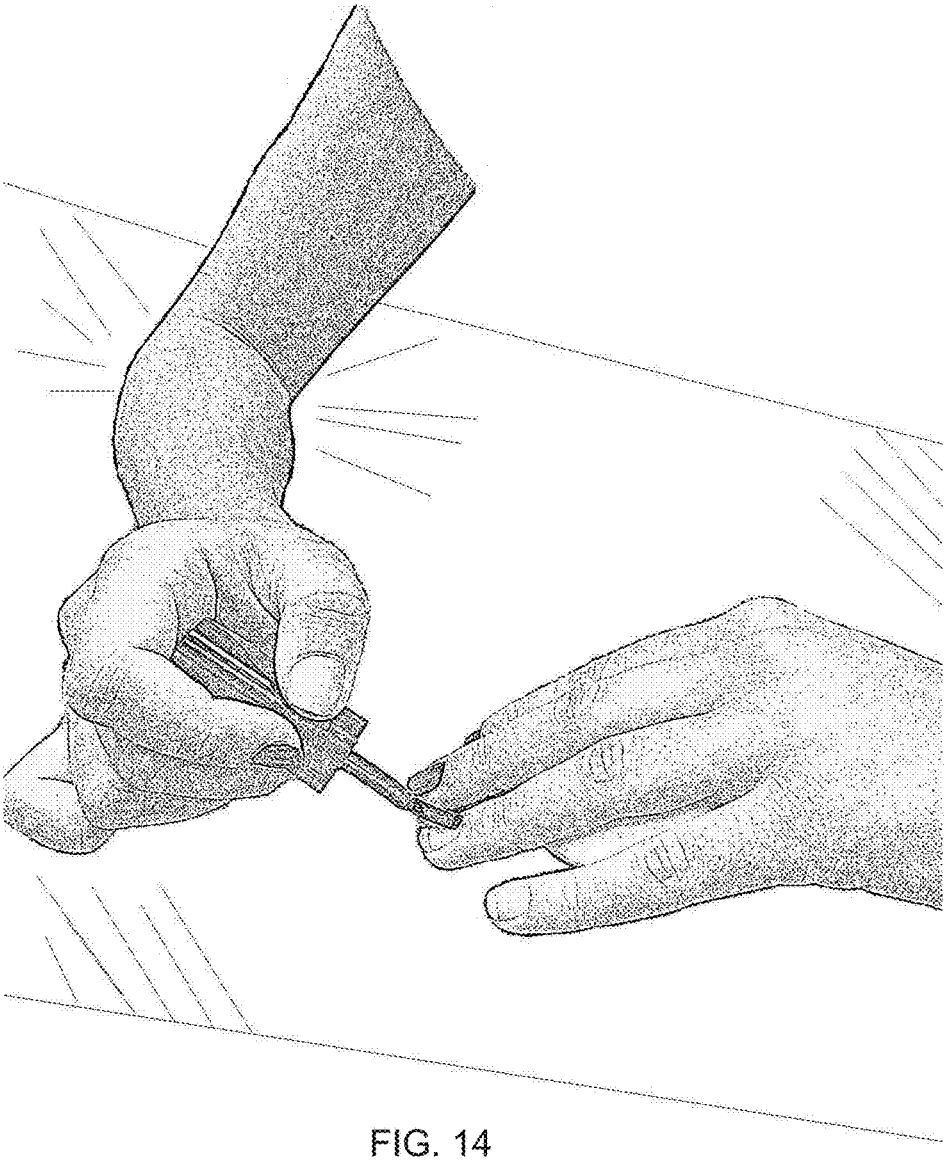
FIG. 14 shows use of one embodiment of the invention with one hand on the device applying nail polish using the other hand which rests comfortably and steadily on the table during application.
Figure 15:
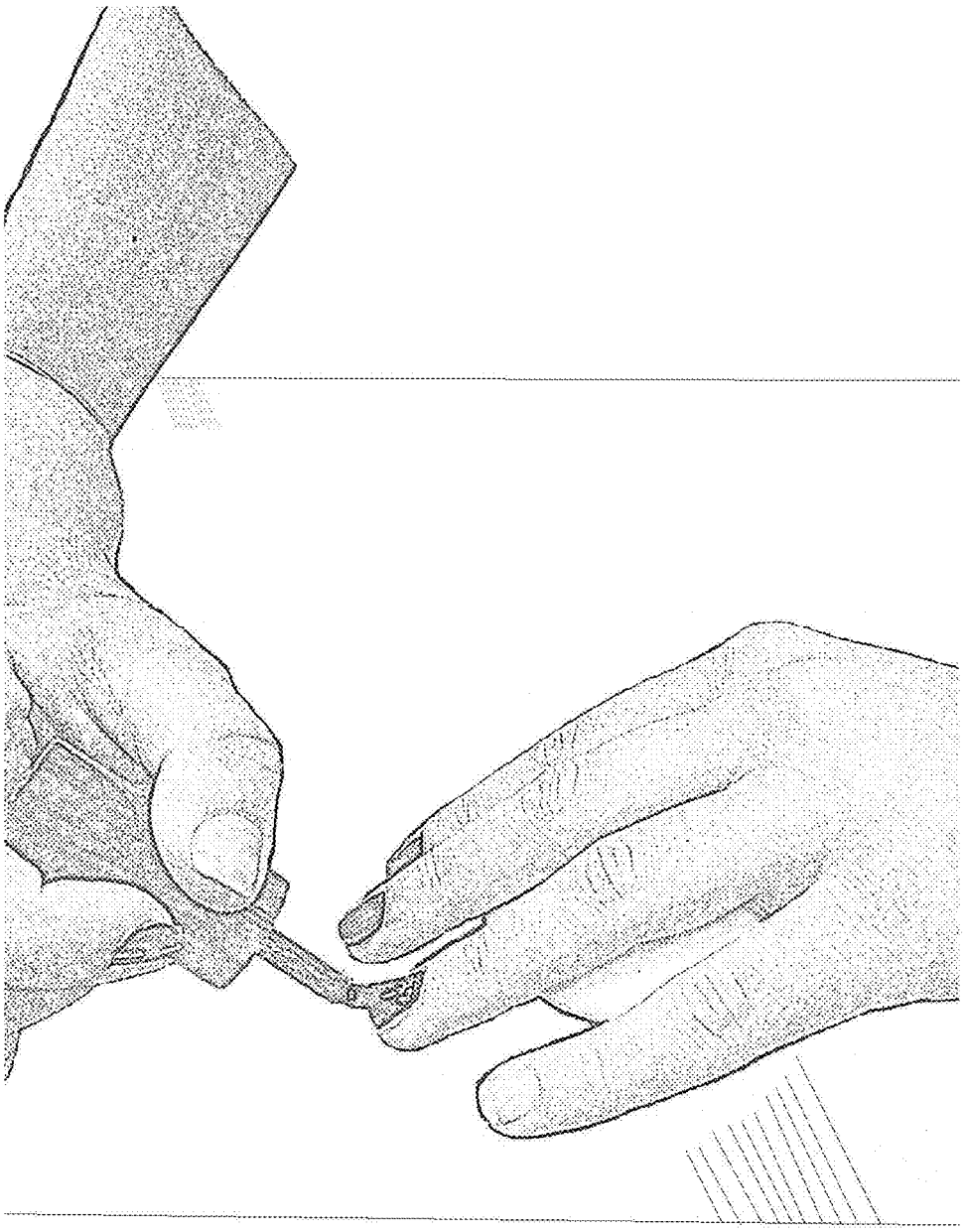
FIG. 15 shows how the angle between the nail polish brush and the nail created though use of the device helps to position the bristles on the nail polish brush against but not on top of the cuticle to achieve a neat and clean polish without overlap onto the cuticle.

FIGS. 13-16 show how to use the device according to the invention. The hand rest device is placed on the supporting surface such as a table or counter and a user places his or her hand on top of the device. There is no set position that the hand must be placed on top of the device. The user can adjust positioning until he/she finds a comfortable spot for hand placement, but it is preferred that the peak of the device is positioned towards the middle of the palm or the lower portion of the user's palm closest to the wrist. The digits (fingers) should drape down over the edge of the device with the finger tips resting on the supporting surface. The thumb will rest on the supporting surface next to the device. With slight pressure on the finger tips, the finger nails on all of the finger except the thumb will be positioned at approximately 45 degrees with the supporting surface. Preferably, the forearm is rested in the supporting surface providing a comfortable ergonomic position for the user's arm and shoulder. The shoulder does not need to be lifted when using the device thereby reducing tension in the user's shoulder and arm during the nail polish application process. The invention's design allows for the hand to lay in such a way that when the nail polish brush is put in contact with the finger nail, the bristles of the brush do not reach past the cuticle. Instead, the top of the brush first touches the nail just under the cuticle, creating a neat application of polish by pulling the brush down the nail. The user may then polish his or her nails or someone else can polish his/her nails while resting the hand that is holding the polish brush on the supporting surface as shown in FIGS. 14-16.

When the user wants to paint the thumb nail, he/she may place his or her thumb on top of the device with the back of the thumb resting on the peak of the device and the tip of the thumb pointing downward and resting on the downward sloping curvature on the top surface of the device. The thumb nail may then be painted as usual.

The present invention allows for the user's hand to rest comfortably on a surface while the other hand applies the nail polish. The device helps create an optimal angle for the nail polish brush to touch the nail near the cuticle allowing for a precise application of nail polish. With the nails angled downward, the polish does not pool at the back of the nail by the cuticle; instead, due to gravity, the extra polish draws downward to the free edge of the nail, creating a neat and clean polish application.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

I claim:

1. A hand rest device for use during the application of nail polish comprising:

a front, a back, a right side, a left side, a top surface, and a bottom surface;

said top surface configured in a generally convex shape with a rounded peak positioned on a back half of said top surface in a longitudinal direction and about the middle of the top surface in a lateral direction across said top surface; said top surface curving down from said peak to an outer edge of the hand rest device;

said bottom surface configured with a curved portion from the outer edge of the hand rest device to a generally flat portion of said bottom surface, said generally flat portion of said bottom surface further comprising a plurality of rubber pads on the bottom surface; and a weight inside said device.

2. The hand rest device according to claim 1, said device comprising a maximum height less than about ½ of the maximum width of said device.

3. The hand rest device according to claim 2, said maximum height of said device is about ⅓ of the maximum length of said device.

4. The hand rest device according to claim 3, wherein said maximum height is about 27 millimeters.

5. The hand rest device according to claim 4, wherein said maximum width is about 66 millimeters.

6. The hand rest device according to claim 4, wherein said maximum length is about 82 millimeters.

7. The hand rest device according to claim 1, wherein said weight weighs between about 50 to 100 grams.

8. A two-piece construction hand rest device for use during the application of nail polish comprising:

a top cover detachably connected to a bottom cover along a rounded edge forming a front, a back, a right side, a left side, a top surface, and a bottom surface for said device;

said top surface configured in a generally convex shape with a rounded peak positioned on a back half of said top surface in a longitudinal direction and about the middle of the top surface in a lateral direction across said top surface; said top surface curving down from said peak to an outer edge of the hand rest device;

said bottom surface configured with a curved portion from the outer edge of the hand rest device to a generally flat portion of said bottom surface, said generally flat portion of said bottom surface further comprising a plurality of rubber pads on the bottom surface; and a weight inside said device between said top cover and said bottom cover.

9. The hand rest device according to claim 8, said device comprising a maximum height less than about ½ of the maximum width of said device.

10. The hand rest device according to claim 9, said maximum height of said device is about ⅓ of the maximum length of said device.

11. The hand rest device according to claim 10, wherein said maximum height is about 27 millimeters.

12. The hand rest device according to claim 11 wherein said maximum width is about 66 millimeters.

13. The hand rest device according to claim 11, wherein said maximum length is about 82 millimeters.

14. The hand rest device according to claim 8, wherein said weight weighs between about 50 to 100 grams.

15. The hand rest device according to claim 8 wherein said top surface comprises a chrome coated finish.

16. The hand rest device according to claim 8, wherein said top surface comprises a metal finish.

17. The hand rest device according to claim 8, wherein said top surface includes a contoured indentation positioned longitudinally between said peak and said outer edge at said front, said contoured indentation generally shaped like the bottom of a thumb.

18. A hand rest device for use during the application of nail polish comprising:

a front, a back, a right side, a left side, a top surface, and a bottom surface;

said top surface configured in a generally convex shape with a rounded peak positioned on a back half of said top surface in a longitudinal direction and about the middle of the top surface in a lateral direction across said top surface; said top surface curving down from said peak to an outer edge of the hand rest device;

said bottom surface configured with a curved portion from the outer edge of the hand rest device to a generally flat portion of said bottom surface, said generally flat portion of said bottom surface further comprising a plurality of rubber pads on the bottom surface;

wherein said peak is positioned, along a length of the device from said front to said back, forward from said back approximately ⅓ of the total length of said device.

19. The hand rest device according to claim 18, wherein said peak is positioned, along a width of the device from said left side to said right side, at approximately the middle of said width.

* * * * *